US008106738B2

(12) United States Patent
Sin

(10) Patent No.: US 8,106,738 B2
(45) Date of Patent: Jan. 31, 2012

(54) BALLAST FOR MULTIPLE LAMPS AND METHOD OF MANUFACTURING THE SAME

(75) Inventor: Ho-Sub Sin, Choongcheongbuk-do (KR)

(73) Assignee: Sang Yong Illumination Co., Cheongwon-gun (KR)

( * ) Notice: Subject to any disclaimer, the term of this patent is extended or adjusted under 35 U.S.C. 154(b) by 260 days.

(21) Appl. No.: 12/626,651

(22) Filed: Nov. 26, 2009

(65) Prior Publication Data

US 2010/0134044 A1 Jun. 3, 2010

(30) Foreign Application Priority Data

Nov. 28, 2008 (KR) ..... 10-2008-0119737

(51) Int. Cl.
*H01F 27/30* (2006.01)

(52) U.S. Cl. ..... 336/196; 336/221; 336/220; 336/213; 336/199

(58) Field of Classification Search ..... 336/196, 336/198, 199–213, 219, 220, 221; 315/274–287, 315/262, 224, 209 R
See application file for complete search history.

(56) References Cited

U.S. PATENT DOCUMENTS 6,154,113 A * 11/2000 Murai ..... 336/198
6,771,157 B2 * 8/2004 Nishikawa et al. ..... 336/178
8,022,803 B2 * 9/2011 Park et al. ..... 336/208

* cited by examiner

*Primary Examiner* — Tuyet Thi Vo
(74) *Attorney, Agent, or Firm* — LRK Patent Law Firm

(57) ABSTRACT

Disclosed herein is a ballast for multiple lamps and a method of manufacturing the ballast. A first coil is wound around a bobbin which has a partition formed in the center portion of an inner space thereof. An insulating sheet is stacked on the first coil, and a second coil is wound around the insulating sheet. Two paired core elements are vertically coupled to each other to form each core. Ends of the core elements disposed outside the bobbin are connected, and ends of the core elements disposed inside the bobbin are spaced apart from each other by the thickness of the bobbin partition, to form a path for magnetic flux.

8 Claims, 5 Drawing Sheets

[FIG. 1]
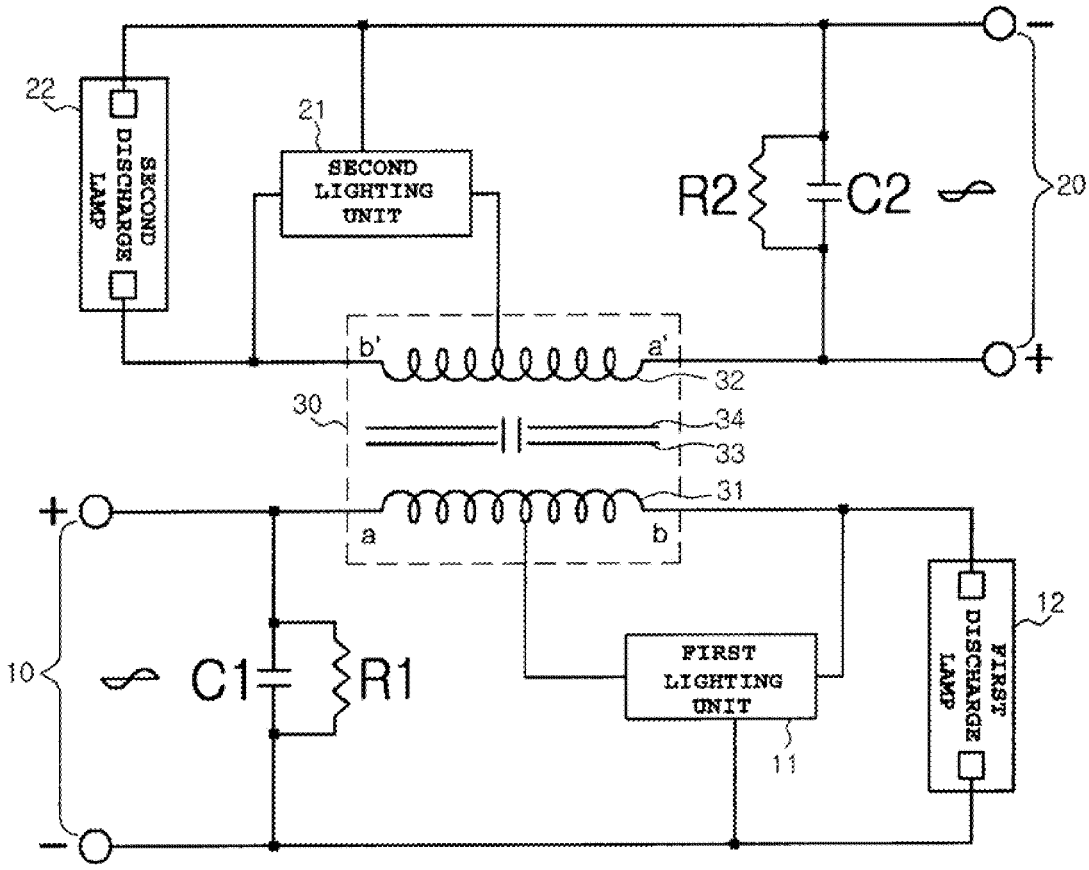

[FIG. 2]
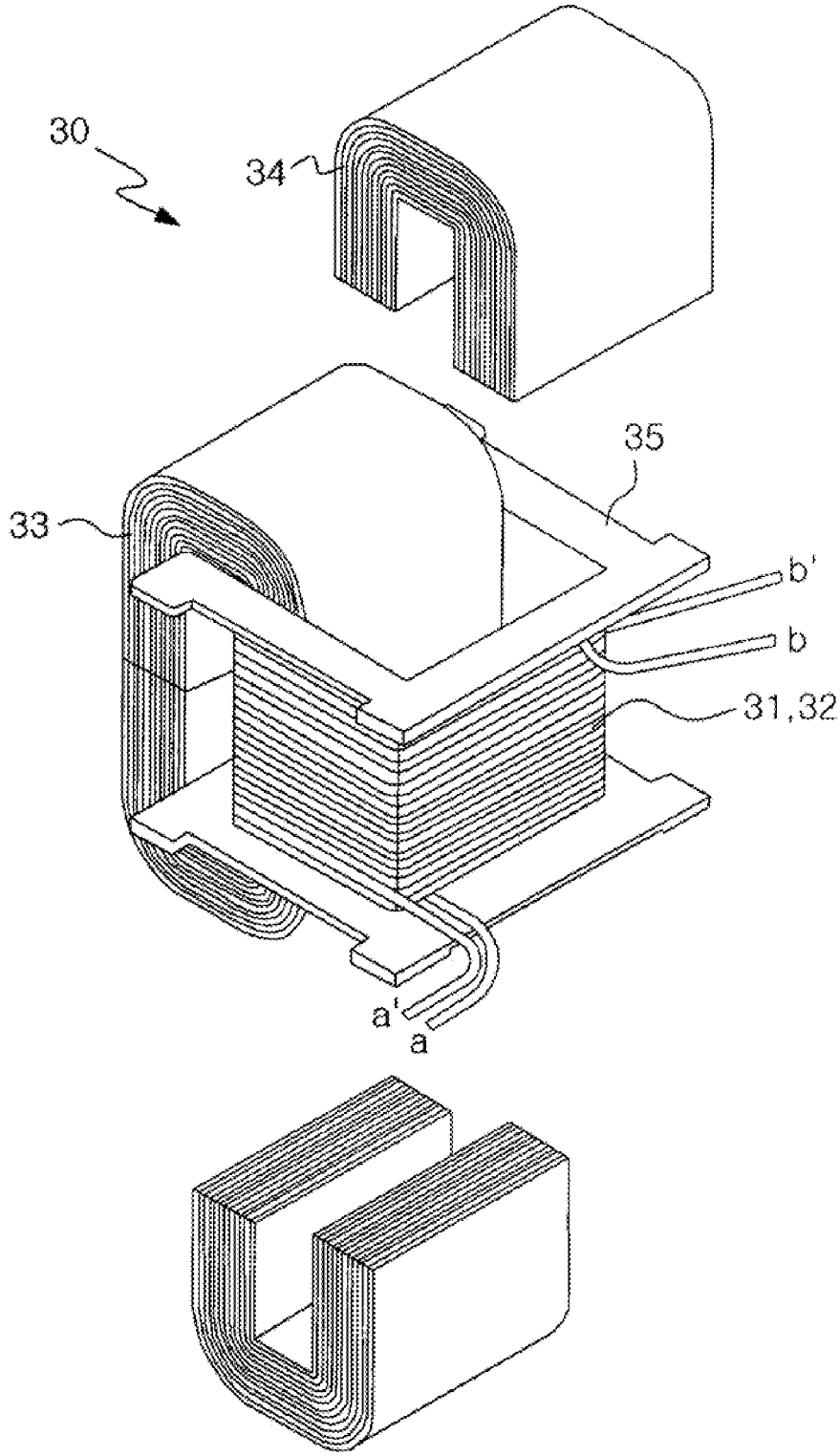

[FIG. 3]
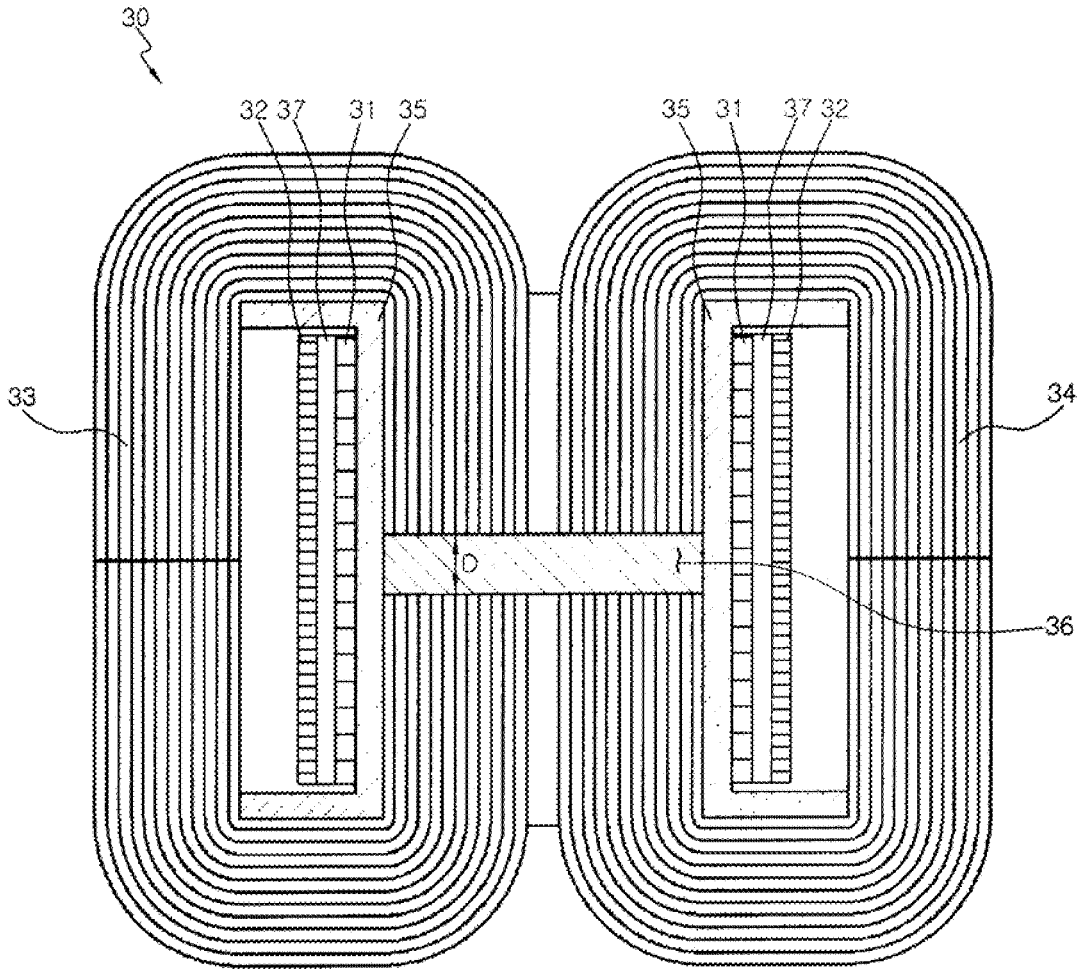

[FIG. 4]
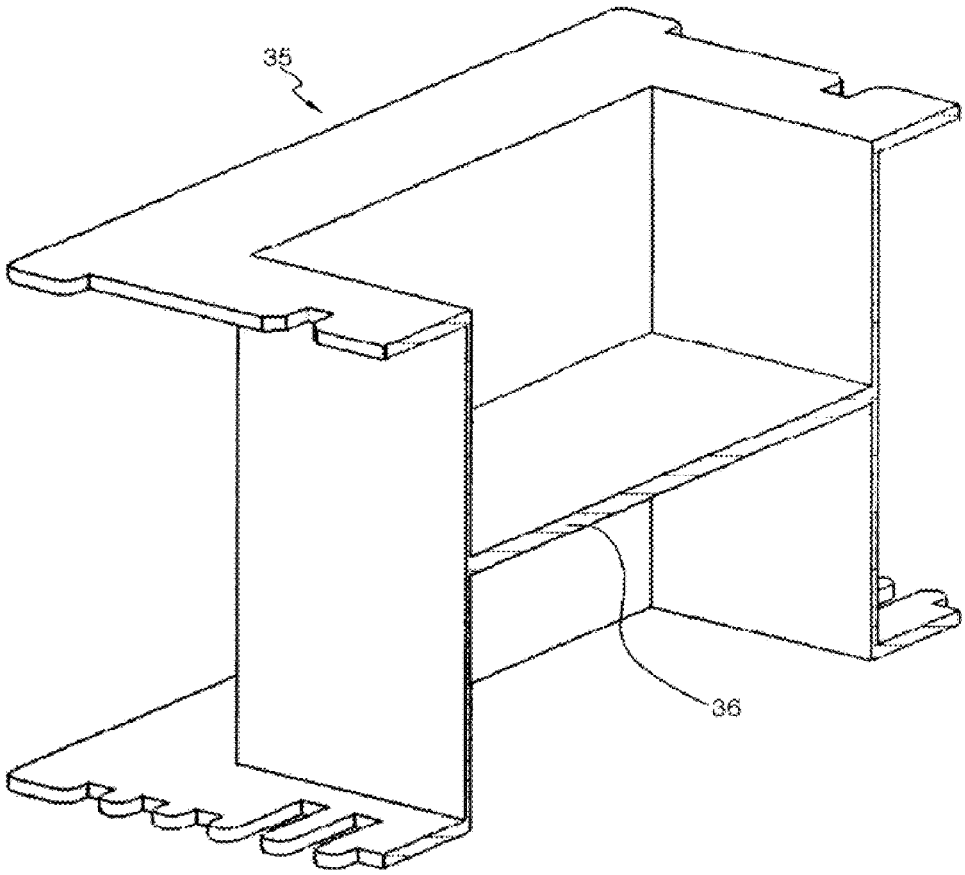

[FIG. 5]
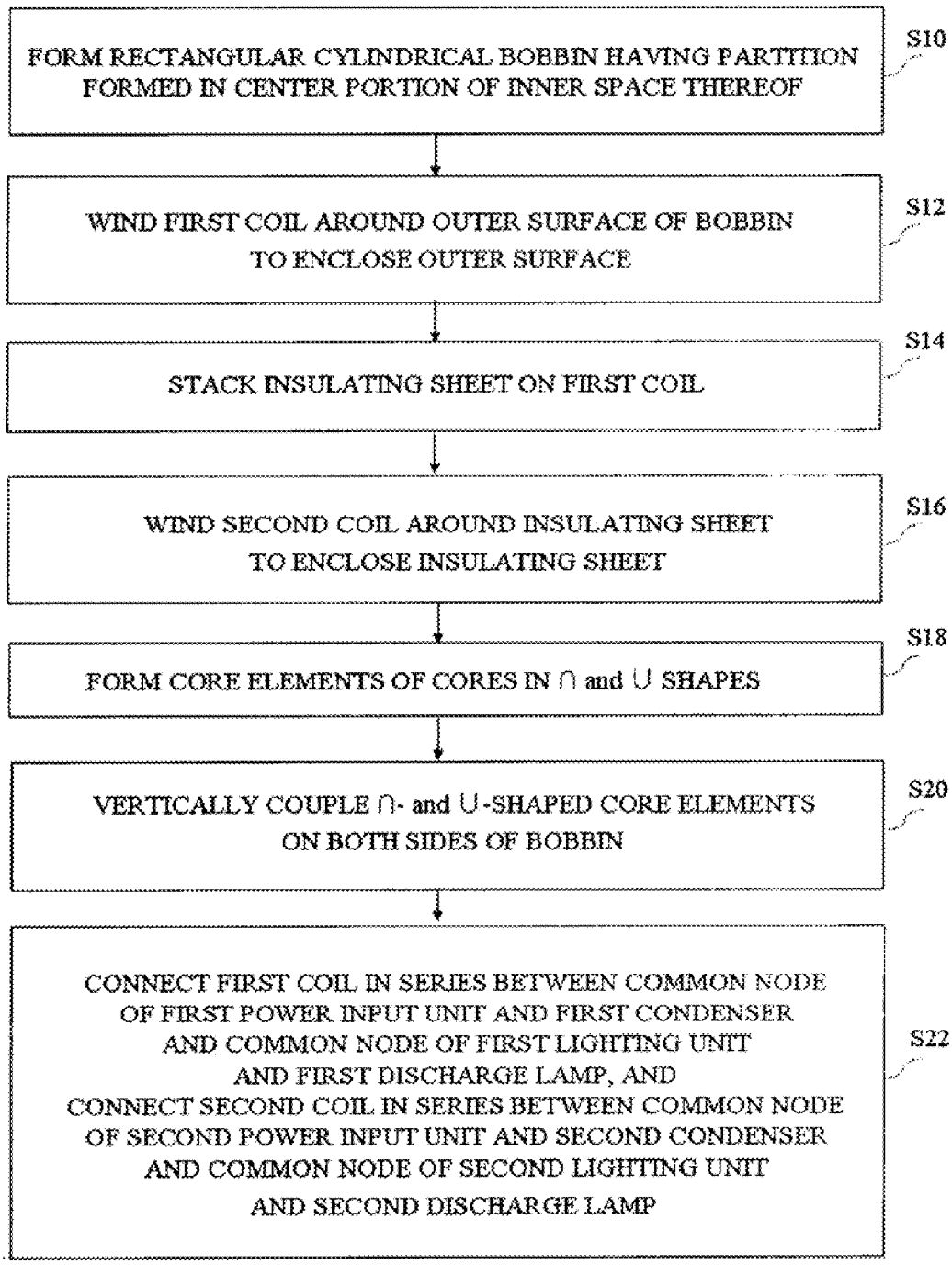

BALLAST FOR MULTIPLE LAMPS AND METHOD OF MANUFACTURING THE SAME

BACKGROUND OF THE INVENTION

1. Field of the Invention

The present invention relates, in general, to a ballast for a circuit for lighting discharge lamps, and, more particularly, toga ballast for multiple lamps, which is used in a circuit for simultaneously lighting multiple discharge lamps, and a method of manufacturing the ballast.

2. Description of the Related Art

Once a discharge lamp, which is a lamp that generates light by means of an internal electrical discharge between electrodes in a gas, is directly connected to a power supply and current starts to flow through the discharge lamp, the current suddenly increases, thus instantaneously breaking down the electrode terminal or seal of the discharge lamp. Therefore, a ballast is installed between the power supply and the discharge lamp to suitably control the current in the discharge lamp.

Generally, a magnetic ballast is composed of one or more coils, each having a core, which has inductance, and is configured to supply a constant current by preventing the current from increasing.

A conventional ballast is formed such that an I-type core and an E-type core, each composed of a plurality of silicon steel sheets according to the relevant capacity, are mutually assembled to a bobbin around which coils are wound so as to form magnetic force lines in a predetermined movement direction.

However, such a conventional ballast is configured to light only one discharge lamp, so it is problematic in that it cannot be used in a circuit for simultaneously lighting multiple discharge lamps. Further, the conventional ballast is problematic because welding must be performed when the bobbin, the I-type core, and the E-type core are mutually assembled, so light and gas generated during welding not only cause air pollution but are also harmful to humans, thus deteriorating production efficiency and increasing manufacturing costs.

SUMMARY OF THE INVENTION

Accordingly, the present invention has been made keeping in mind the above problems occurring in the prior art, and an object of the present invention is to provide a ballast for multiple lamps and a method of manufacturing the ballast, which can increase power efficiency by driving multiple discharge lamps using one ballast, and can improve production efficiency by facilitating the assembly of the ballast and enabling the automation of production.

In order to accomplish the above object, the present invention provides a ballast for multiple lamps, comprising: a rectangular cylindrical bobbin provided with a partition formed in a center portion of an inner space thereof; a first coil wound around an outer surface of the bobbin to enclose the outer surface and configured to control current flowing through a first discharge lamp; an insulating sheet stacked on the first coil to enclose the first coil; a second coil wound around the insulating sheet to enclose the insulating sheet and configured to control current flowing through a second discharge lamp; and first and second cores, each configured to include two paired core elements, which have ∩- and ∪-shaped vertical sections and are vertically coupled to each other on both sides of the bobbin, wherein ends of the core elements disposed outside the bobbin are connected to each other, and ends of the core elements disposed inside the bobbin are spaced apart from each other by an interval corresponding to the thickness of the partition of the bobbin to form a path for magnetic flux.

Further, in order to accomplish the above object, the present invention provides a method of manufacturing a ballast for multiple lamps, comprising: forming a rectangular cylindrical bobbin provided with a partition formed in a center portion of an inner space thereof; winding a first coil around an outer surface of the bobbin to enclose the outer surface; stacking an insulating sheet on the wound first coil to enclose the first coil; winding a second coil around the insulating sheet to enclose the insulating sheet; forming a first core and a second core, each including paired core elements having ∩- and ∪-shaped vertical sections; and vertically coupling the paired ∩- and ∪-shaped core elements of the first core to each other and vertically coupling the paired ∩- and ∪-shaped core elements of the second core to each other on both sides of the bobbin.

BRIEF DESCRIPTION OF THE DRAWINGS

The above and other objects, features and advantages of the present invention will be more clearly understood from the following detailed description taken in conjunction with the accompanying drawings, in which:

FIG. 1 is a diagram showing a circuit for a ballast for multiple lamps according to the present invention;

FIG. 2 is a perspective view showing the assembly of the ballast for multiple lamps according to the present invention;

FIG. 3 is a sectional view of the ballast for multiple lamps according to the present invention;

FIG. 4 is a sectional perspective view showing the bobbin of the ballast for multiple lamps according to the present invention; and FIG. 5 is a flowchart showing a method of manufacturing the ballast for multiple lamps according to the present invention.

DESCRIPTION OF THE PREFERRED EMBODIMENTS

Hereinafter, embodiments of the present invention will be described in detail with reference to the attached drawings.

The present invention is intended to simultaneously control currents flowing through multiple discharge lamps at a constant level by using one ballast, and is configured such that cores are formed in a predetermined shape to enable a group of coils to be wound around a bobbin and to be mounted on the bobbin, so that welding is not required, assembly is easily facilitated, and the automation of production is possible, thus improving the production efficiency of products.

FIG. 1 is a diagram showing an example of a circuit for a ballast for multiple lamps according to the present invention.

As shown in FIG. 1, a first discharge lamp 12 is connected to a first power input unit 10 for supplying Alternating Current (AC) power, and both a first condenser C1 and a first lighting unit (or a first igniting unit) 11 are connected between the first power input unit 10 and the first discharge lamp 12 in parallel with the first discharge lamp 12. Further, a second discharge lamp 22 is connected to a second power input unit 20 for supplying AC power, and both a capacitor C2 and a second lighting unit (or a first igniting unit) 21 are connected between the second power input unit 20 and the second discharge lamp 22 in parallel with the second discharge lamp 22. In order to allow respective currents flowing through the first discharge lamp 12 and the second discharge lamp 22 to be constant, a ballast 30 for multiple lamps according to the present invention is connected between a common node a of the first power input unit 10 and the first condenser C1 and a common node b of the first lighting unit 11 and the first discharge lamp 12, and between a common node a' of the second power input unit 20 and the second condenser C2 and a common node b' of the second lighting unit 21 and the second discharge lamp 22.

The first and second lighting units 11 and 21 function to initiate the lighting of the first discharge lamp 12 and the second discharge lamp 22, respectively, and supply surge voltages to the first discharge lamp 12 and the second discharge lamp 22, respectively, at the time of initiating the lighting thereof.

The ballast 30 performs control such that constant currents are supplied to the first and second discharge lamps 12 and 22 after the first and second discharge lamps 12 and 22 have started to be lit by the first and second lighting units 11 and 21, respectively.

The first and second condensers C1 and C2 are configured to compensate for a decrease in power factor, which occurs when magnetic flux is generated by the current flowing from the AC power supply and is stored as magnetic energy.

Further, a first resistor R1 is connected in parallel with the first condenser C1, and a second resistor R2 is connected in parallel with the second condenser C2.

The first resistor R1 and the second resistor R2 are provided to prevent a user from being shocked by electricity due to the voltages remaining in the first and second condensers C1 and C2.

FIG. 2 is a perspective view showing the assembly of the ballast 30 for multiple lamps according to the present invention, FIG. 3 is a sectional view showing the ballast 30 for multiple lamps of FIG. 1 according to the present invention, and FIG. 4 is a perspective view showing the section of the bobbin of the ballast 30 for multiple lamps of FIG. 1 according to the present invention. The ballast 30 for multiple lamps according to the present invention includes a rectangular cylindrical bobbin 35, a first coil 31, an insulating sheet 37, a second coil 32, and first and second cores 33 and 34. The rectangular cylindrical bobbin 35 is provided with a partition 36 formed in the center portion of the inner space thereof. The first coil 31 is wound around the outer surface of the bobbin 35 to enclose the outer surface and is configured to control current flowing through the first discharge lamp 12. The insulating sheet 37 is formed to enclose the first coil 31. The second coil 32 is wound around the insulating sheet 37 to enclose the insulating sheet 37, and is configured to control current flowing through the second discharge lamp 22. Each of the first and second cores 33 and 34 includes two paired core elements, which respectively have ∩- and ∪-shaped vertical sections and are vertically coupled to each other on each of both sides of the bobbin 35. In this case, in each of the first and second cores 33 and 34, the ends of the core elements thereof disposed outside the bobbin 35 are connected to each other, and the ends of the core elements thereof disposed inside the bobbin 35 are spaced apart from each other by an interval corresponding to the thickness of the partition 36 of the bobbin 35 to enable a gap to be formed between the ends, and are configured to form a path for magnetic flux. The first coil 31 is connected in series between the common node of the first power input unit 10 and the first condenser C1 and the common node of the first lighting unit 11 and the first discharge lamp 12. The second coil 32 is connected in series between the common node of the second power input unit 20 and the second condenser C2 and the common node of the second lighting unit 21 and the second discharge lamp 22.

The bobbin 35 is provided with the partition 36, having a predetermined thickness, in the center portion of the hexahedral inner space thereof, and the inner space of the bobbin 35 is separated by the partition 36 to enable an upper space and a lower space to be formed.

Each of the first core 33 and the second core 34 includes two paired core elements, which have ∩- and ∪-shaped vertical sections and are vertically coupled to each other on both sides of the bobbin 35, and which are respectively inserted into the upper space and the lower space of the bobbin 35 while enclosing the wall of the bobbin 35. In the first core 33 composed of a ∩-shaped core element and a ∪-shaped core element, both ends of each of the ∩- and ∪-shaped core elements have different lengths so that the first ends of the ∩- and ∪-shaped core elements disposed outside the bobbin 35 come into close contact with each other, and the second ends of the ∩- and ∪-shaped core elements disposed inside the bobbin 35 are formed to be spaced apart from each other by an interval corresponding to the thickness of the partition 36 of the bobbin 35. Further, similarly to the first core 33, the second core 34 is also configured such that both ends of each of the core elements have different lengths.

The thickness of the partition 36 of the bobbin 35, that is, the interval D formed in each of the first and second cores 33 and 34, is determined according to the power consumption W of the first and second discharge lamps 12 and 22, and thus the interval varies depending on the capacities of the first and second coils 31 and 32. Further, the capacity of each of the first and second coils 31 and 32 wound around the bobbin 35 is determined by the thickness and the number of turns of the first and second coils 31 and 32, respectively. Therefore, the output currents of the first and second discharge lamps 12 and 22 can be controlled by the interval D formed in each of the first and second cores 33 and 34, and the thickness and the number of turns of each of the first and second coils 31 and 32.

The thickness of the first coil 31 is slightly greater than that of the second coil 32. In this case, when a plurality of coils is wound around the bobbin, the entire size of the ballast can be reduced.

Meanwhile, a tap (not shown) is provided in the center portion of each of the first and second coils 31 and 32, and the first lighting unit 11 and the second lighting unit 21 are connected to the respective taps. Therefore, the first and second lighting units 11 and 21 can supply stable surge voltages to the first and second discharge lamps 12 and 22, respectively.

When the ballast for multiple lamps according to the present invention is operated to stabilize the input currents of two discharge lamps, it is connected between two lighting circuits; that is, a first lighting circuit and a second lighting circuit, as shown in FIG. 1. The first lighting circuit is formed such that the first power input unit 10, the first condenser C1, the first resistor R1, the first lighting unit 11 and the first discharge lamp 12 are connected in parallel. The second lighting circuit is formed such that the second power input unit 20, the second condenser C2, the second resistor R2, the second lighting unit 21 and the second discharge lamp 22 are connected in parallel.

The ballast for multiple lamps according to the present invention can be operated to control currents flowing through multiple discharge lamps using one ballast by winding a plurality of coils around the outer surface of the bobbin 35 and connecting the respective coils to lighting circuits for discharge lamps so that the lighting circuits correspond to the coils in a one-to-one manner.

FIG. 5 is a flowchart showing a method of manufacturing the ballast for multiple lamps according to the present invention.

First, the rectangular cylindrical bobbin 35 having a partition formed in the center portion of the inner space thereof is formed at step S10. The first coil 31 is wound around the outer surface of the bobbin 35 to enclose the outer surface at step S12. The insulating sheet 37 is stacked on the wound first coil 31 to enclose the first coil 31 at step S14. The second coil 32 is wound around the insulating sheet 37 to enclose the insulating sheet 37 at step S16. Therefore, the insulating sheet 37 insulates the first coil 31 and the second coil 32 from each other.

A method of assembling the cores 33 and 34 to the bobbin 35 according to the present invention will be described below.

First, the ∩-shaped core elements and the ∪-shaped core elements are formed at step S18. A method of forming the core elements will be described in detail below. A silicon steel sheet, or in other words a plate, which is cut to a predetermined width and length, is wound around the outside of a mold, the cross-section of which is formed to have a rectangular shape as in the case of a hexahedron, a predetermined number of times using a rotating machine, and is then stacked. Thereafter, when the wound plate is thrown into a container filled with an adhesive and is impregnated with the adhesive, or when the adhesive is injected into spaces between the layers of the plate, the stacked plate layers adhere to each other due to the adhesive and are thus integrated into one structure, thereby forming each elliptical core. The center portion of the elliptical core is cut in the direction of a minor axis (lateral direction), so that core elements, the sections of which have approximate ∩ and ∪ shapes in the direction of a major axis (vertical direction), are formed. Further, the core elements are cut in such a way that the lengths of the first ends of the core elements are slightly shorter than those of the second ends thereof. Accordingly, when the two core elements having ∩ and ∪ shapes are assembled as one pair, the first ends thereof are spaced apart from each other by a predetermined interval (that is, the thickness of the partition 36 of the bobbin 35), and the second ends thereof come into close contact with each other.

The ∩- and ∪-shaped core elements are vertically inserted into the space of the bobbin 35 on both sides of the bobbin 35, so that the first core 33 and the second core 34 are assembled at step S20. The first ends of the core elements disposed inside the bobbin 35 are spaced apart from each other by the thickness of the partition 36. The second ends of the core elements disposed outside the bobbin 35 come into close contact with each other, and are connected to each other using adhesive tape, an adhesive band or a clip.

When the ballast 30 for multiple lamps is formed in this way, the first coil 31 of the ballast 30 for multiple lamps is connected in series between the common node of the first power input unit 10 and the first condenser C1 and the common node of the first lighting unit 11 and the first discharge lamp 12. Further, the second coil 32 is connected in series between the common node of the second power input unit 20 and the second condenser C2 and the common node of the second lighting unit 21 and the second discharge lamp 22.

The operation of the lighting circuits to which the ballast for multiple lamps according to the present invention formed in this way is connected will be described in detail with reference to FIG. 1.

When AC power is applied via the first power input unit 10, the applied power passes through one terminal of the first power input unit 10, the first coil 31 of the ballast 30 for multiple lamps, the first lighting unit 11 and the first discharge lamp 12, and then flows through the other terminal of the first power input-unit 10.

The first lighting unit 11 provides a surge voltage to the first discharge lamp 12, so that the first discharge lamp 12 is lit and discharged. As the power is applied to the first coil 31 of the ballast 30 for multiple lamps, magnetic flux is generated in the cores 33 and 34, so that electrical energy is converted into magnetic energy, thus controlling current flowing through the first discharge lamp 12 to be constant. In this case, in order to compensate for a decrease in power factor, occurring when electrical energy is converted into magnetic energy and is then stored, the first condenser C1 is provided. In order to prevent the user from being shocked by electricity because of power remaining in the first condenser C1, the first resistor R1 is connected in parallel with the first condenser C1.

Further, when AC power is applied through the second power input unit 20, the applied power passes through one terminal of the second power input unit 20, the second coil 32 of the ballast 30 for multiple lamps, the second lighting unit 21 and the second discharge lamp 22, and then flows through the other terminal of the second power input unit 20. Accordingly, the power is applied to the second coil 32 connected in series between the common node of the second power input unit 20 and the second condenser C2 and the common node of the second lighting unit 21 and the second discharge lamp 22, and thus the ballast 30 for multiple lamps can drive the second discharge lamp 22.

Therefore, the present invention can drive multiple discharge lamps using one ballast 30 for multiple lamps.

As described above, the present invention is advantageous because it can simultaneously drive multiple discharge lamps using one ballast, thus simplifying the entire circuit structure for lighting multiple discharge lamps, and improving power efficiency.

Further, the present invention enables the automation of a series of processes in which a plurality of coils forming a group is wound around the outer surface of a rectangular cylindrical bobbin, having a partition formed in the center portion of the inner space thereof, to enclose the outer surface so that the coils are individually insulated from each other by an insulating sheet, and in which ∩- and ∪-shaped core elements are vertically coupled to each other on both sides of the bobbin. Accordingly, the present invention is advantageous because production efficiency can be improved and mass production is possible, thus reducing production costs.

Furthermore, the present invention is advantageous in that a partition is provided in the center portion of the inner space of a rectangular cylindrical bobbin of the ballast for multiple lamps to form an interval (gap) in cores assembled to the bobbin, thus not only preventing the formed gap from being exposed to air and impurities from flowing into the bobbin, but also omitting a separate insulating means, and reducing eddy loss that may occur in the gap, and thus high efficiency can be realized. Furthermore, the present invention is advantageous because core elements constituting cores to be assembled to the bobbin of the ballast for multiple lamps are formed in ∩ and ∪ shapes to allow the edges thereof to be bent, so that eddy loss can be reduced, and thus high efficiency can be realized.

Those skilled in the art will appreciate that the present invention can be implemented in modified forms, without departing from the scope and spirit of the invention. The above embodiments are not intended to limit the present invention, but are intended to describe the present invention. Therefore, those skilled in the art will appreciate that various modifications, additions and substitutions are possible from the above embodiments. Therefore, the scope of the present invention should be defined by the technical spirit of the accompanying claims.

What is claimed is:

1. A ballast for multiple lamps, comprising:

a rectangular cylindrical bobbin provided with a partition formed in a center portion of an inner space thereof;

a first coil wound around an outer surface of the bobbin to enclose the outer surface and configured to control current flowing through a first discharge lamp;

an insulating sheet stacked on the first coil to enclose the first coil;

a second coil wound around the insulating sheet to enclose the insulating sheet and configured to control current flowing through a second discharge lamp; and first and second cores, each configured to include two paired core elements, which have ∩- and ∪-shaped vertical sections and are vertically coupled to each other on both sides of the bobbin, wherein ends of the core elements disposed outside the bobbin are connected to each other, and ends of the core elements disposed inside the bobbin are spaced apart from each other by an interval corresponding to the thickness of the partition of the bobbin to form a path for magnetic flux.

2. The ballast according to claim 1, wherein the first coil is connected in series between a common node of a first power input unit and a first condenser of a lighting circuit for the first discharge lamp and a common node of a first lighting unit and the first discharge lamp; and wherein the second coil is connected in series between a common node of a second power input unit and a second condenser of a lighting circuit for the second discharge lamp and a common node of a second lighting unit and the second discharge lamp.

3. The ballast according to claim 1, wherein the first and second discharge lamps are configured such that power consumption of the first discharge lamp is determined by the thickness and the number of turns of the first coil and the interval formed in the first and second cores, and such that power consumption of the second discharge lamp is determined by the thickness and the number of turns of the second coil and the interval formed in the first and second cores.

4. A method of manufacturing a ballast for multiple lamps, comprising:

forming a rectangular cylindrical bobbin provided with a partition formed in a center portion of an inner space thereof;

winding a first coil around an outer surface of the bobbin to enclose the outer surface;

stacking an insulating sheet on the first coil to enclose the first coil;

winding a second coil around the insulating sheet to enclose the insulating sheet;

forming a first core and a second core, each including paired core elements having ∩- and ∪-shaped vertical sections; and vertically coupling the paired ∩- and ∪-shaped core elements of the first core to each other and vertically coupling the paired ∩- and ∪-shaped core elements of the second core to each other on both sides of the bobbin.

5. The method according to claim 4, further comprising:

connecting the first coil between a first power input unit and a first discharge lamp of a lighting circuit for the first discharge lamp, and connecting the second coil between a second power input unit and a second discharge lamp of a lighting circuit for the second discharge lamp.

6. The method according to claim 4, further comprising:

connecting the first coil in series between a common node of a first power input unit and a first condenser of a lighting circuit for the first discharge lamp and a common node of a first lighting unit and the first discharge lamp, and connecting the second coil in series between a common node of a second power input unit and a second condenser of a lighting circuit for the second discharge lamp and a common node of a second lighting unit and the second discharge lamp.

7. The method according to claim 4, wherein the vertical coupling of the core elements of the first and second cores on both sides of the bobbin comprises:

vertically assembling the ∩- and ∪-shaped core elements constituting the first core and the ∩- and ∪-shaped core elements constituting the second core on both sides of the bobbin; and causing first ends of the core elements disposed inside the bobbin to be spaced apart from each other by the thickness of the partition of the bobbin, and connecting second ends of the core elements disposed outside the bobbin to each other.

8. The method according to claim 4, wherein the first and second discharge lamps are configured such that power consumption of the first discharge lamp is determined by the thickness and the number of turns of the first coil and the interval formed in the first and second cores, and such that power consumption of the second discharge lamp is determined by the thickness and the number of turns of the second coil and the interval formed in the first and second cores.

* * * * *